US005788136A

United States Patent [19]

Othman

[11] Patent Number: 5,788,136

[45] Date of Patent: Aug. 4, 1998

[54] PAPER ROLL HOLDER WITH BRAKE FOR DISPENSING USE

[76] Inventor: Sven-Ivar Valdermar Othman, Sjöstranden 7 bostad 6, FIN-02320 Esbo, Finland

[21] Appl. No.: 553,395

[22] PCT Filed: May 24, 1994

[86] PCT No.: PCT/FI94/00204

§ 371 Date: Nov. 21, 1995

§ 102(e) Date: Nov. 21, 1995

[87] PCT Pub. No.: WO94/27483

PCT Pub. Date: Dec. 8, 1994

[30] Foreign Application Priority Data

May 25, 1993 [FI] Finland ..... 932362

[51] Int. Cl.[6] ..... A47K 10/38; B65H 23/08

[52] U.S. Cl. ..... 225/79; 225/82; 242/422.4; 242/422.5; 242/597.7

[58] Field of Search ..... 225/51, 52, 73, 225/79, 82, 46, 70, 77, 67; 242/419, 421.8, 422.4, 422.5, 597.7, 421; 226/195

[56] References Cited

U.S. PATENT DOCUMENTS

| | | | |
|---|---|---|---|
| 846,194 | 3/1907 | Finan | 225/82 |
| 1,518,749 | 12/1924 | Nelson | 225/67 |
| 2,211,210 | 8/1940 | Johnson | 225/51 X |
| 2,500,254 | 3/1950 | Lankford, Jr. | 225/51 X |
| 2,668,022 | 2/1954 | Fairfield | 225/51 X |
| 2,752,106 | 6/1956 | Thompson | 242/422.5 |
| 3,281,089 | 10/1966 | Krueger et al. | 242/422.4 |
| 4,720,053 | 1/1988 | Vance | 242/423.2 |
| 4,832,271 | 5/1989 | Geleziunas | 242/422.5 |
| 4,848,690 | 7/1989 | Lemoine | 225/51 X |
| 5,174,518 | 12/1992 | Hongo et al. | 242/422.5 |

FOREIGN PATENT DOCUMENTS

WO9409690 5/1994 WIPO .

*Primary Examiner*—Clark F. Dexter
*Attorney, Agent, or Firm*—Christie, Parker & Hale, LLP

[57] ABSTRACT

The invention relates to a paper roll holder with a brake for dispensing use of paper rolls or the like. The paper roll holder comprises a heavy base to which two column-like parts are fixed, against which the paper roll rests and in between which the paper runs and which at their ends have suitably shaped cutting edges or serration, if the paper web is not perforated. A split ring member including ring and wedge-shaped parts as well as a cover with a spring fixed to it are mounted in bearings to the column-like parts and a spring fixed to the base are all pressing the paper roll against the column-like parts. The form, roughness and weight of the cover and column-like parts the split ring member and the the spring forces of the springs are chosen so that by pulling the paper it easily unwinds but the paper breaks off with a little jerk using only one hand. In the roll holder also, paper rolls without a core can be used and then springs in the cover and base are not needed, or the holder can be built without the split ring member, in which case only the springs press the paper roll against the column-like parts. The holder is normally placed on the table but can also, by transforming the base, be fixed to the wall.

7 Claims, 2 Drawing Sheets

PAPER ROLL HOLDER WITH BRAKE FOR DISPENSING USE

BACKGROUND OF THE INVENTION

Today the use of paper toweling is widely spread. From a practical point of view it is advantageous to place the paper roll in a holder. There are holders that are fixed on the wall or kept under the cupboard or on the table.

Known are for instance holders, where a pole is fixed to the base, and this pole then forms the center axis of the paper roll. This holder easily tips over and furthermore it is not provided with a brake, in which case the use of both hands is needed for taking a paper. Known also is a holder where, as in the above holder, there is a base and a center pole and on the top of the center pole a plate with a hole into which the center pole fits. This plate has enough weight to have a braking effect on the paper roll. In this holder malfunctions have been observed, it may tip over and the braking system does not always function.

Mainly due to the design of the paper towel and toilet paper holders, the paper rolls for these have been manufactured by rolling paper around a core. However, the core cannot be utilized. Considering the overall manufacturing of toweling and toilet roll paper and the like, the manufacturing of unutilized cores is extensive.

Paper rolls are also manufactured without cores and in this case they are intended to be unwound from the center of the paper roll. However, this results in the paper being twisted like a cord.

SUMMARY OF THE INVENTION

In a holder according to this invention dispensing use of paper manufactured with or without cores can easily be done. The material used for the core could be used for the real product, the paper itself.

By using a design according to this invention the paper will, when pulling easily, unwind and break with a little jerk.

The characteristics of the invention appear in the patent claims.

DETAILED DESCRIPTION

Figure 1:
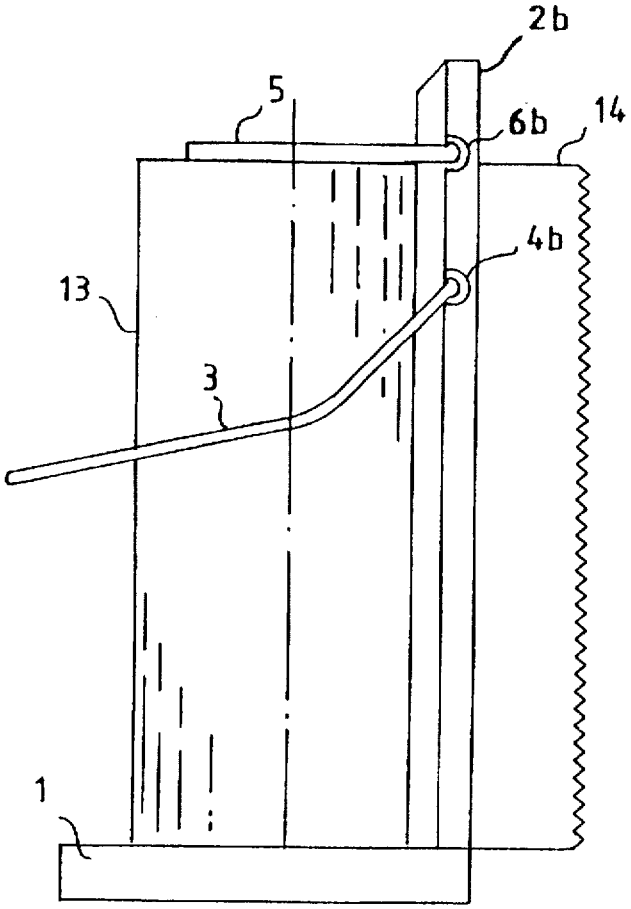
FIG. 1 is a side view of a paper roll holder constructed in accordance with the invention.
Figure 3:
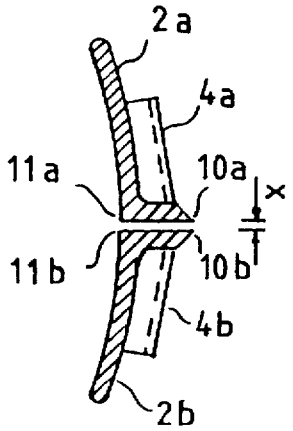
FIG. 3 is a horizontal cross-section of the column-like parts.
Figure 2A:
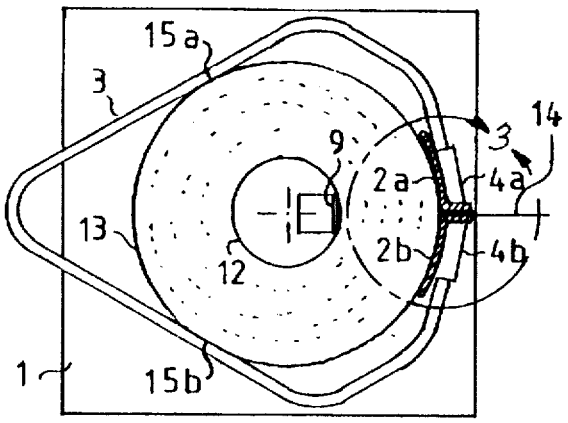
FIG. 2A is a horizontal section of the holder with a paper roll with a core.
Figure 2B:
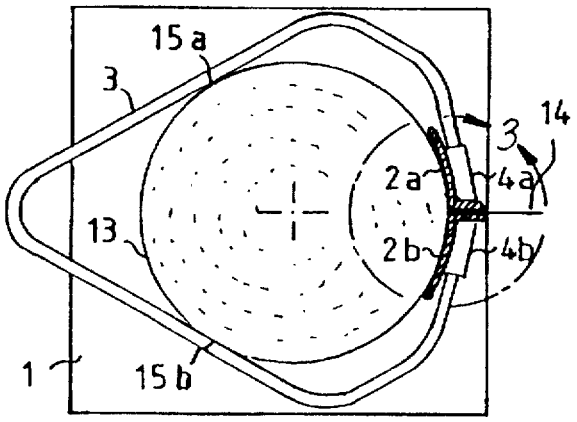
FIG. 2B is a horizontal section of the holder with a paper roll without a core.
Figure 4:
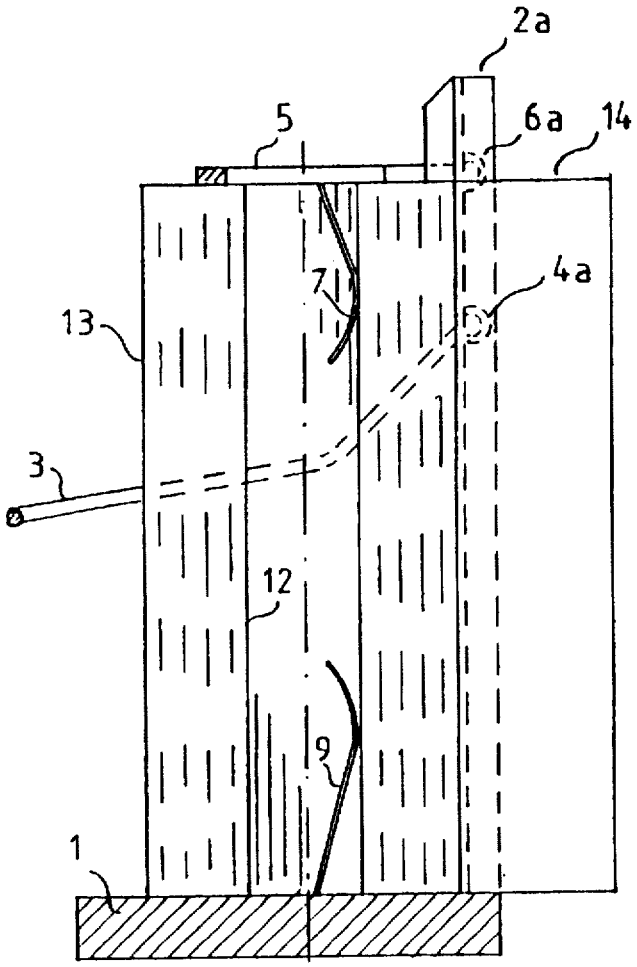
FIG. 4 is a vertical cross-section of the holder.
Figure 5:
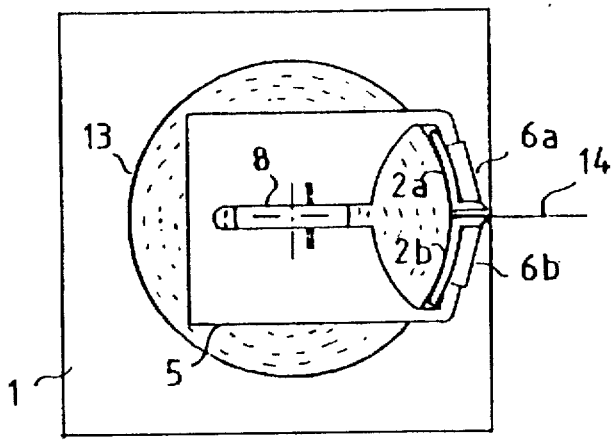
FIG. 5 is the holder shown from above.

The invention comprises a heavy base, part 1 in FIG. 1 to which one or two suitably shaped column-like parts 2*a* and/or 2*b* in FIG. 1 are fixed, in between which is a gap x, as shown in FIG. 3. Along the inner edges of parts 2*a* and 2*b* there are squared edges, 11*a* and 11*b*. In FIG. 3 the outer edges of parts 2*a* and 2*b* are provided with suitably shaped cutting edges, 10*a* and 10*b*. The invention also comprises a split ring member 3 which at one end is ring-shaped, and at its other end wedge-shaped as shown in FIGS. 2A and 2B, the ring-shaped portion being slightly bigger than the full paper roll which is mounted in bearings 4*a* and 4*b* of parts 2*a* and 2*b* in FIGS. 2A and 2B. The invention also comprises a cover 5 spring-mounted in bearings 6*a* and 6*b* of parts 2*a* and 2*b* to hold the paper roll in its place, especially if the paper roll is not vertical, to which cover a spring 7 (FIG. 4) is fixed. In the cover 5 in FIG. 5 there is an opening 8. In the base 1 as shown in FIG. 4, a spring 9 is fixed. Around the board core 12 of the paper roll 13, the paper 14 is wrapped.

The loading of the roll holder with rolls with a core, as shown in FIG. 2A, is done so that cover 5 and split ring member 3 in FIG. 1 both are lifted up and turned about 180°. After this, paper roll 13 in FIG. 4 will be put into its place so that spring 9 fits into board core 12 as shown in FIG. 4. The paper 14 in FIG. 2A is threaded through gap x between parts 2*a* and 2*b*. The opening 8 in cover 5 in FIG. 5 facilitates threading paper 14 through gap x. Finally the split ring member 3 in FIG. 1 and cover 5 will be turned so that they both are resting on roll 13 in FIG. 1.

If the paper roll has no core it is possible to get along only with split ring member 3 in addition to the base 1 and the column-like parts 2*a* and 2*b*.

The loading of the roll holder with rolls without a core, as shown in FIG. 2B, is done so that the split ring member 3 in FIG. 1 is lifted up and turned about 180°. After this, paper roll 13 in FIG. 2B will be placed against the column-like parts 2*a* and 2*b* and paper 14 in FIG. 2B will be threaded through gap x between parts 2*a* and 2*b*. Finally the split ring member 3 is turned back so that it rests on paper roll 13 as shown in FIG. 1.

The form, roughness and weight of split ring member 3 in FIGS. 2A and 2B; the form, roughness and weight of cover 5 in FIG. 4; and spring forces and roughness of surfaces of springs 7 and 9 are all chosen so that by pulling paper 14 in FIG. 4 with an even speed, roll 13 unwinds easily, but with a small jerk paper 14 breaks at its perforation line using only one hand.

Because split ring member 3 is also wedge-shaped, it touches paper roll 13 in the two points 15*a* and 15*b* hence giving side stability to roll 13. The more paper 14 in FIGS. 2A and 2B is pulled and the diameter of paper roll 13 decreases, the more the split ring member 3, because of its own weight and its mounting in bearings 4*a* and 4*b*, will move downwards. Thus, the paper roll 13 all the time will be in a wedge consisting of four outer points 15*a*, 15*b* and the touching points at 2*a* and 2*b*. When pulling paper 14 in FIGS. 2A and 2B, the paper roll rotates under a braking force as split ring member 3 presses paper roll 13 and springs 7 and 9 press board core 12 of paper roll 13 in FIG. 4 against column-like parts 2*a* and 2*b* in FIG. 2 in which case the friction as well as the braking effect increase. The tear-off can also be facilitated by furnishing column-like parts 2*a* and 2*b* with suitably squared inner edges 11*a* and 11*b* in FIG. 3.

The invention can be designed in many ways depending on the size of the roll, the strength of the paper material, etc. If perforated paper is not used, outer edges 10*a* and 10*b* of parts 2*a* and 2*b* could be provided with a necessary serration.

Generally the holder is placed for example on a table. The holder can be formed and built of many materials, e.g. steel, a plastic coated thread-like metal structure, metal profiles, injection molding, etc., in which case the design may be different.

By reforming base 1 in FIG. 1 and by replacing the gravity force by suitable springs, the holder can be manufactured to stay on the table, to be fixed to the wall, etc. The gravity force of split ring member 3 in FIGS. 2A and 2B can be replaced by an external spring or the like, the form, weight and roughness of cover 5 and form and roughness of the surfaces, and spring force of springs 7 and 9, of which only one or both can be outside roll 13 and hence pressing on the outer part of roll 13 so that the split ring member 3 in FIG. 2A is not needed, or if rolls with or without cores are used, split ring member 3 in FIGS. 2A and 2B is shaped and its weight and roughness of the surface chosen so that neither cover 5 with its spring 7 nor spring 9 is needed, in which case also the roll could be horizontal. The ring-shaped part 3 in FIG. 4 can be one or several and being several they can be combined with each other with a spring or the like or the split ring member 3 in FIG. 4 which has a bearing in only one of the column-like parts 2*a* or 2*b* in FIG. 2A or 2B and there is just one column-like part 2*a* or 2*b* in which split ring member 3, shaped as an open loop or several loops, has a bearing mounting.

What is claimed is:

1. A free standing paper roll holder for dispensing a sheet of paper from a roll comprising:

a base;

a vertically extending column attached to the base along which said sheet of paper is guided, the vertically extending column comprising a cutting edge;

means for pressing the exterior of the roll against the vertically ending column;

a cover attached to the dispenser above the base and wherein the pressing means comprises a first spring operatively connected to the base and a second spring operatively connected to the cover, said springs positioned away from the vertically extending column and biased towards the vertically extending column whereby said springs fit into a core of the roll and press the roll against the vertically extending column.

2. The free standing paper roll holder of claim 1 wherein the springs comprise leaf springs.

3. The free standing paper roll holder of claim 1 wherein the cutting edge of the column is serrated.

4. A free standing paper roll holder for dispensing a sheet of paper from a comprising:

a base;

a vertically extending column attached to the base along which said sheet of paper is guided, the vertically extending column comprising a cutting edge;

means for pressing the exterior of the roll against the vertically extending column, said pressing means comprising a split ring member having a pair of ends, one of said pair of ends pivotably connected to the vertically extending column above the base, wherein the split ring member is positioned over the base for fitting over and weighing against the roll, thereby pressing the roll against the vertically extending column.

5. The free standing paper roll holder of claim 4 wherein the cutting edge of the column is serrated.

6. The free standing paper roll holder of claim 4 further comprising another vertically extending column attached to the base proximate the other vertically extending column such that a gap is formed therebetween through which the sheet of paper is guided.

7. The free standing paper roll holder of claim 4 wherein the vertically extending column has a curved surface for corresponding to a curvature of the exterior of said roll.

* * * * *